US012326012B2

(12) United States Patent
Wei et al.

(10) Patent No.: US 12,326,012 B2
(45) **Date of Patent: *Jun. 10, 2025**

(54) SWIMMING POOL CLEANER

(71) Applicant: Yunda H&H Tech (Tianjin) Co., Ltd., Tianjin (CN)

(72) Inventors: Enyu Wei, Tianjin (CN); Hao Xu, Tianjin (CN); Huixin Zhang, Tianjin (CN); Yu Peng, Tianjin (CN); Yinping Yuan, Tianjin (CN); Xu Yang, Tianjin (CN)

(73) Assignee: YUNDA H&H TECH (Tianjin) CO., LTD., Tianjin (CN)

( * ) Notice: Subject to any disclaimer, the term of this patent is extended or adjusted under 35 U.S.C. 154(b) by 227 days.

This patent is subject to a terminal disclaimer.

(21) Appl. No.: 18/116,955

(22) Filed: Mar. 3, 2023

(65) Prior Publication Data

US 2024/0279951 A1 Aug. 22, 2024

(30) Foreign Application Priority Data

Feb. 17, 2023 (CN) ..... 202310133788.2

(51) Int. Cl.
*E04H 4/16* (2006.01)
*B63H 1/14* (2006.01)
*B63H 25/52* (2006.01)

(52) U.S. Cl.
CPC ..... *E04H 4/1654* (2013.01); *B63H 1/14* (2013.01); *B63H 25/52* (2013.01); *E04H 4/1636* (2013.01)

(58) Field of Classification Search
CPC ..... E04H 4/16; E04H 4/1654; E04H 4/1636
See application file for complete search history.

(56) References Cited

U.S. PATENT DOCUMENTS

2020/0299987 A1* 9/2020 Bruneel ..... E04H 4/1663
2020/0332546 A1* 10/2020 Borg ..... F01C 21/0809
(Continued)

FOREIGN PATENT DOCUMENTS

CN 114233063 A 3/2022
CN 114837476 A 8/2022
(Continued)

OTHER PUBLICATIONS

CN114233063A—English translation of abstract.
CN114837476A—English translation of abstract.
CN114895691B—English translation of abstract.

*Primary Examiner* — Michael D Jennings
(74) *Attorney, Agent, or Firm* — Kirk A. Wilson; Joseph T. Guy; Patent Filing Specialist Inc.

(57) ABSTRACT

A swimming pool cleaner is provided, which includes a housing, a travelling device and a filter screen, two groups of power components with opposite driving directions are provided inside the water outlet chamber, the power component includes an impeller and a water outlet channel, wherein the water outlet channel includes a spiral portion and a linear flowing portion which are sequentially communicated, the linear flowing portion is connected with the water outlet, and the linear flowing portion deflects to the outer side in the spiral direction of the spiral portion, a steering stressed portion is formed at the junction of the linear flowing portion and the spiral portion, and the water outlet is in communication with an outside of the housing and faces towards a direction that is opposite to the travelling direction of the travelling device.

14 Claims, 15 Drawing Sheets

(56) References Cited

U.S. PATENT DOCUMENTS

| | | | | |
|---|---|---|---|---|
| 2021/0156163 | A1* | 5/2021 | Cao | A47L 11/4044 |
| 2023/0250664 | A1* | 8/2023 | Tang | E04H 4/1654 |
| 2024/0294242 | A1* | 9/2024 | Wei | B63B 79/15 |

FOREIGN PATENT DOCUMENTS

| | | | |
|---|---|---|---|
| CN | 114895691 | B | 8/2022 |
| EP | 3805487 | B1 | 12/2021 |
| WO | WO2004035237 | A2 | 4/2004 |
| WO | WO2017060588 | A2 | 4/2017 |

* cited by examiner

SWIMMING POOL CLEANER

CROSS REFERENCE TO RELATED APPLICATION

This patent application claims the benefit and priority of Chinese Patent Application No. 2023101337882, entitled "Swimming Pool Cleaner" filed on Feb. 17, 2023, the disclosure of which is incorporated by reference herein in its entirety as part of the present application.

TECHNICAL FIELD

The present disclosure relates to the technical field of cleaning technology for the swimming pool, and in particular, to a swimming pool cleaner.

BACKGROUND ART

Dust, impurities, garbage and the like often enter the swimming pool, which causes the pollution to the environment of the swimming pool and affects the experience of a swimmer, therefore, the swimming pool needs to be cleaned regularly. At present, the swimming pool is mostly cleaned by people, which has problems such as inconvenience in cleaning and waste of labor. There is also an underwater robot on the market for cleaning the ground of the swimming pool, and the private swimming pool or the public swimming pool is cleaned using the underwater robot. The swimming pool cleaning robot can not only save labor, but also clean the swimming pool more thoroughly compared with people. Therefore, cleaning the swimming pool with the swimming pool cleaning robot replacing people is a development trend.

In order to achieve a thorough cleaning effect, it is crucial to design a cleaning route for the swimming pool cleaning robot when it is used to clean the swimming pool. Chinese Patent Application Authorization No. CN 114895691 B discloses a path planning method and device for a swimming pool cleaning robot, wherein a plurality of control units are provided to control the robot to detect the target and to travelling path, and the position and the position to be moved are determined by means of electronic means. According to the solution, by means of path planning, a travelling position of the robot can be accurately controlled to satisfy the purpose of cleaning the swimming pool thoroughly. However, with regard to the arrangement of excessive control units and electronic elements, the costs are significantly increased, which is not conducive to promotion and use. Furthermore, controlling the travelling direction with electronic elements will obviously increase the complexity of a structure, which increase the costs and the failure rate at the same time.

Also, Chinese Patent Application Publication No. CN 114233063 A discloses a swimming pool cleaning robot and a steering method, the swimming pool cleaning robot includes a cleaning robot main body, an angle sensor, a gyro sensor, and an acceleration sensor arranged inside the cleaning robot main body, and further includes a first sonar and a second sonar fixed on one side of the cleaning robot main body in the travelling direction. The solution are provided with precise electronic elements which do not require path planning, and can be directly used in the swimming pool. However, as in the described patent with the Patent Authorization No. CN 114895691 B, a large number of electronic elements are used which increase the costs, and the steering system is also complicated.

In conclusion, in the prior art, for the path control of the swimming pool robot, a manner such as path planning or electronic element identification control is often used, there is no doubt that complex controlling systems and steering systems will be added, and electronic elements with relatively high prices will be applied, which is not conducive to cost control. Therefore, how to better implement travelling of the swimming pool robot on the basis of a simple structure and low costs is a technical problem indeed presented in the art.

SUMMARY

An objective of the present disclosure is to provide a swimming pool cleaner, so as to solve the problem in the prior art described above. By designing a water outlet channel to have a spiral portion and a linear flowing portion, a steering stressed portion can be formed between the spiral portion and the linear flowing portion, while extracting and filtering a water in a swimming pool, using a flowing of the water flow to form an impact on the steering stressed portion, so that the swimming pool cleaner can be deflected in an impact direction, and finally forms a zigzag travelling route. The swimming pool cleaner of the present disclosure do not require additional electronic components such as steering member and state monitoring member, so that costs can be reduced.

To achieve the above objective, the present disclosure provides the following solutions:

Provided is a swimming pool cleaner, it comprises a housing, a travelling device arranged at a bottom of the housing, and a filter screen arranged inside the housing, wherein the filter screen divides a space inside the housing into a water inlet chamber and a water outlet chamber, the water inlet chamber is in communication with water inlets at the bottom of the housing, two groups of power components with opposite driving directions are arranged in the water outlet chamber, and each of the two groups of power components comprise an impeller and a water outlet channel, the water outlet channel comprises a spiral portion and a linear flowing portion which are sequentially communicated, and an inlet of the impeller is communicated with the water outlet chamber, an outlet of the impeller is in communication with the spiral portion, the linear flowing portion is connected to a water outlet, and the linear flowing portion deflects to an outer side of a spiral direction of the spiral portion, a steering stressed portion is formed at a junction of the linear flowing portion and the spiral portion, and the water outlet is in communication with an outside of the housing and faces towards a direction that is opposite to the travelling direction of the travelling device.

Preferably, one of the water inlets is located on a right side of the travelling device with respect to the travelling direction of the travelling device, and the steering stressed portion is subjected to a counterclockwise deflecting force; alternatively, one of the water inlets is located on a left side of the travelling device, and the steering stressed portion is subjected to a clockwise deflecting force; a scraper is provided at a rear side of each of the water inlets.

Preferably, the travelling device comprises travelling wheels, each of the travelling wheels is rotatably mounted on a wheel frame via a wheel shaft, a positioning block and an annular groove are provided on a top of the wheel frame, a positioning groove is arranged at a position on the housing corresponding to the positioning block, a first buckle is provided corresponding to the annular groove, and the first buckle clamps into the annular groove to fix the wheel frame; the wheel frame is provided with a large through-hole and a small through-hole for being penetrated by the wheel shaft; the wheel shaft comprises a small diameter portion and a large diameter portion which are connected to each other, wherein the small diameter portion has a diameter smaller than that of the small through-hole, and the large diameter portion has a diameter between the diameter of the small through-hole and a diameter of the large through-hole.

Preferably, the travelling wheels are disposed on an outer surface of a bottom of the housing in a cross-shaped arrangement, a gravity center of one of the travelling wheels at a front side and a gravity center of one of the travelling wheels at a rear side are provided in an offset arrangement, and are offset towards respective water inlets.

Preferably, a flow distribution plate is arranged in the linear flowing portion in a direction parallel to an extending direction of the linear flowing portion, the water outlet has a flared structure, a swing-out baffle is hinged to the water outlet at an upper part of the swing-out baffle, and the swing-out baffle seals the water outlet by its own weight when it is not subjected to an impact of a water flow.

Preferably, the housing is provided with wall contact sensing assemblies, wherein each of the wall contact sensing assemblies comprises a swinging member rotatably arranged on the housing and a Hall sensing probe fixedly arranged on the housing, the swinging member comprises a rotation portion, a resistance plate and a magnet seat which are connected to the rotation portion and, and a magnet is mounted on the magnet seat, the resistance plate is located in a contact wall detection water channel which penetrates from front to back, and when the resistance plate is subjected to an action of a water flow, the magnet deflects away from the Hall sensing probe, and when the resistance plate is not subjected to the water flow, the magnet corresponds to the Hall sensing probe.

Preferably, arc-shaped grooves is comprised, a central shaft is rotatably erected on two side walls of each of the arc-shaped grooves, the rotation portion is rotatably sleeved on the central shaft, two ends of the central shaft are respectively provided with two shaft shoulders, the two shaft shoulders are rotatably clamped on the two side walls of a corresponding one of the arc-shaped grooves, and a distance between the two shaft shoulders is greater than an axial width of the swinging member.

Preferably, the magnet seat comprises a swinging arm connected to one side of the rotation portion close to the Hall sensing probe, and a magnet mounting portion connected to the swinging arm, a water-facing surface of the swinging arm is provided as a wedge shape, and the magnet is provided on one side of the magnet mounting portion close to the Hall sensing probe, a first counterweight block is arranged on one side of the magnet mounting portion away from the Hall sensing probe.

Preferably, each of the water inlets is hinged to a swing-in baffle, the swing-in baffle is connected to a limiting portion, a swing angle of the swing-in baffle is limited to less than 90 degrees by the limiting portion, and the swing-in baffle seals a corresponding one of the water inlets by its own weight when it is not subjected to an impact of a water flow.

Preferably, a U-shaped handle is arranged on a top of the housing, two supporting legs of the U-shaped handle are hinged on the housing, and a top of the U-shaped handle is hollow and is sealed by a handle cover.

The present disclosure achieves the following technical effects with respect to the prior art:

(1) In the present disclosure, by designing a water outlet channel to have a spiral portion and a linear flowing portion, a steering stressed portion can be formed between the spiral portion and the linear flowing portion, while extracting and filtering a water in a swimming pool, using a flowing of the water flow to form an impact on the steering stressed portion, so that the swimming pool cleaner can be deflected in an impact direction, and finally forms a zigzag travelling route. The swimming pool cleaner of the present disclosure do not require additional electronic components such as steering member and state monitoring member, so that costs can be reduced;

(2) In the present disclosure, the water inlets are differentiated according to the arrangement positions of different water inlets, the water inlet provided on the right side of the travelling device is matched with a counterclockwise deflection, and the water inlet provided on the left side of the travelling device is matched with a clockwise deflection, the water inlet can be located at the outer diameter side of the deflection arc; in addition, a scraper is further provided on the rear side of the water inlet, and the dirt on the ground of the swimming pool can be better cleaned by using the scraper and the relationship between the water inlet and the travelling direction;

(3) In the present disclosure, the travelling wheels are disposed on an outer surface of a bottom of the housing in a cross-shaped arrangement, a gravity center of one of the travelling wheels at a front side and a gravity center of one of the travelling wheels at a rear side are provided in an offset arrangement, and are offset towards respective water inlets. When the swimming pool cleaner travels, since the resistance at the side where the water inlet is located is relatively large, the side where the water inlet is located can be better supported, further, under the effect of the deflecting force acting on the steering stressed portion, the deflecting resistance caused by the travelling wheels can be reduced for better realizing deflection of the swimming pool cleaner and the micro arc-shaped travelling of the swimming pool cleaner can be guaranteed;

(4) In the present disclosure, the rotation portion of the swinging member is rotatably connected to the central shaft to form a one-stage rotational connection, the central shaft is rotatably connected to the arc-shaped groove to form a one-stage rotational connection, so that a two-stage rotating connection can be formed, and when one of the one-stage rotations is affected by debris and then cannot rotate, the other of the one-stage rotations can be used to prevent the swinging member from getting stuck, so as to ensure the stable operation of the wall contact sensing assembly. In addition, the distance between the two shaft shoulders of the central shaft is greater than the axial width of the swinging member, so that when the arc-shaped groove is deformed and contracted, two side walls of the arc-shaped groove can be supported, thereby preventing the two side walls of the arc-shaped groove from affecting the swinging of the swinging member, and further improving the operation reliability of the wall contact sensing assembly;

(5) In the present disclosure, the swinging arm is arranged close to the side of the rotation portion close to the Hall sensing probe, which can ensure the stability of the distance between the magnet and the Hall sensing probe, and prevent factor such as the deformation of the swinging arm from causing a deviation in distance between the magnet and the Hall sensing probe and affecting the sensing accuracy of the wall contact sensing assembly; further, the water-facing surface of the swinging arm is provided as a wedge shape, which can further reduce the resistance affecting swing of the swinging member, and improve the reliability of the wall contact sensing assembly;

(6) In the present disclosure, the water inlet is blocked by the swing-in baffle, and when water is drawn, the water can smoothly enter the water inlet chamber via the water inlet, and the swing angle of the swing-in baffle can be limited via the limiting portion, thereby avoiding the problem that the water inlet cannot be sealed by its own weight due to the excessive swing angle thereof, and dirt which have been filtered in the water inlet chamber are discharged again, so that the smooth progress of the cleaning process can be ensured;

(7) In the present disclosure, a U-shaped handle is provided on the top of the housing, the top of the U-shaped handle is provided with a hollow part, and the top of the U-shaped handle can naturally float to be in a vertical state. When it is necessary to extract for charging or repairing, it is convenient to use a tool to clamp the U-shaped handle, so as to facilitate the grabbing of the swimming pool cleaner at the bottom of the swimming pool, thereby improving the convenience of operation.

BRIEF DESCRIPTION OF THE DRAWINGS

To describe the technical solutions in the embodiments of the present disclosure or in the prior art more clearly, the following briefly introduces the accompanying drawings required for describing the embodiments. Apparently, the accompanying drawings in the following description show merely some embodiments of the present disclosure, and a person of ordinary skill in the art may still derive other drawings from these accompanying drawings without creative efforts.

Figure 1:
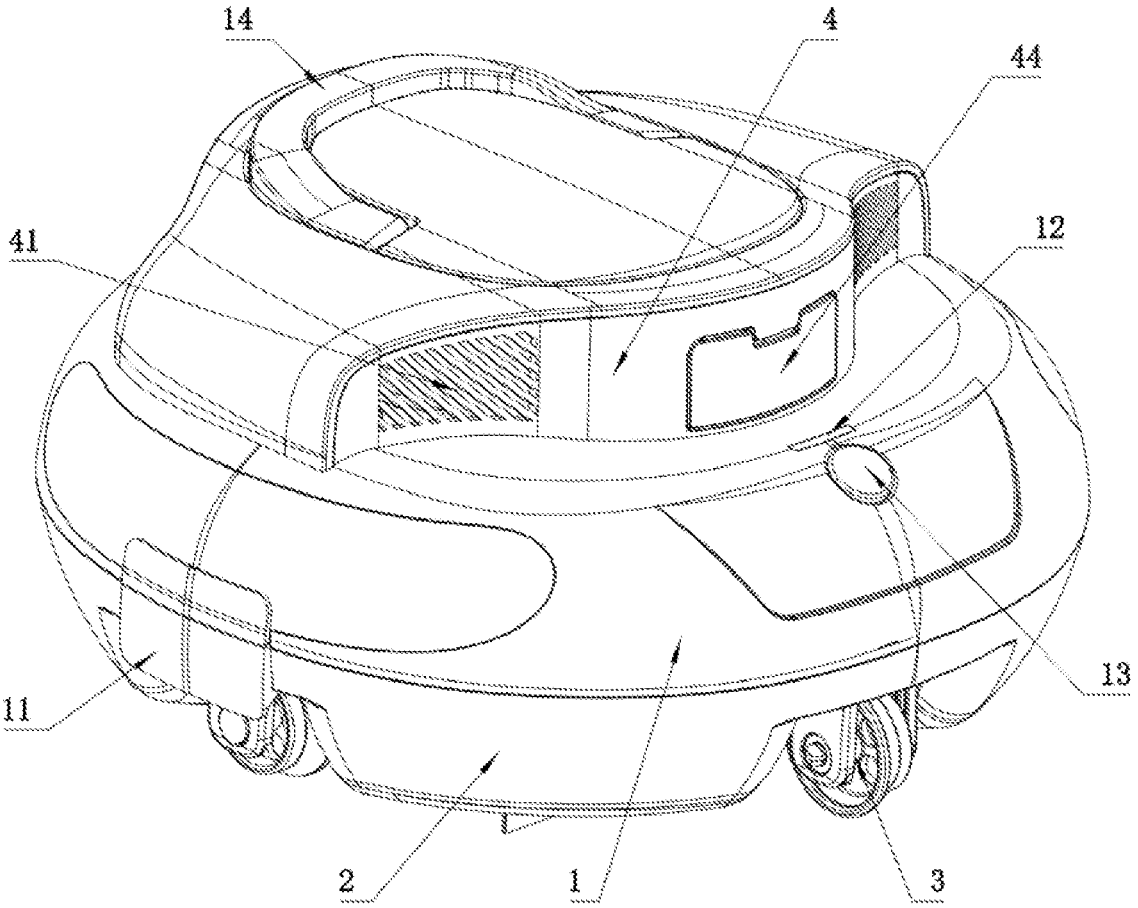
FIG. 1 is a front structural schematic diagram of the present disclosure.

wherein, 1. upper housing; 11. second buckle; 12. indicating light; 13. switch; 14. U-shaped handle; 141. handle cover; 15. water outlet channel; 151. flow distribution plate; 152. spiral portion; 153. linear flowing portion; 154. steering stressed portion; 16. wall contact detection water channel; 2. lower housing; 21. water inlet; 22. blade; 23. charging port; 24. swing-in baffle; 241. limiting portion; 25. first buckle; 26. positioning groove; 3. travelling device; 31. wheel shaft; 32. travelling wheel; 33. wheel frame; 331. annular groove; 332. positioning block; 4. integrated grille plate; 41. protecting grille; 42. water outlet; 43. division plate; 44. swing-out baffle; 5. impeller; 51. inlet; 52. outlet; 6. wall contact sensing assembly; 61. arc-shaped groove; 62. swinging member; 621. resistance plate; 622. rotation portion; 623. swinging arm; 624. magnet mounting portion; 63. central shaft; 7. filter screen; 8. control cabin; 81. battery; 82. motor; 83. Hall sensing probe; 84. liquid level probe; 85. control cabin cover; 9. second counterweight block; 100. water inlet chamber; and 110. water outlet chamber.

DETAILED DESCRIPTION OF THE EMBODIMENTS

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by persons of ordinary skill in the art based on the embodiments of the present disclosure without creative efforts shall belong to the scope of protection of the present disclosure.

An objective of the present disclosure is to provide a swimming pool cleaner, so as to solve the problem in the prior art. By designing a water outlet channel to have a spiral portion and a linear flowing portion, a steering stressed portion can be formed between the spiral portion and the linear flowing portion, while extracting and filtering a water in a swimming pool, using a flowing of the water flow to form an impact on the steering stressed portion, so that the swimming pool cleaner can be deflected in an impact direction, and finally forms a zigzag travelling route. The swimming pool cleaner of the present disclosure do not require additional electronic components such as steering member and state monitoring member, so that costs can be reduced.

To make the objective, features, and advantages of the present disclosure clearer and more comprehensible, the following further describes the present disclosure in detail with reference to the accompanying drawings and specific embodiments.

As shown in FIGS. 1-18, the present disclosure provides a swimming pool cleaner, including a housing, a travelling device 3 arranged at a bottom of the housing, and a filter screen 7 arranged in the housing. The housing can be provided in a separated arrangement, which facilitates disassembly, installation and connection, and facilitates installation of internal components and cleaning of dirt impurities after being disassembled. For example, the housing may include an upper housing 1 and a lower housing 2, wherein the upper housing 1 and the lower housing 2 are clamped via second buckles 11. During disassembly of the housing, the upper housing 1 and the lower housing 2 can be disconnected by turning the second buckles 11 outwards which make both the mounting and disassembling convenient. The travelling device 3 is a rotatable ground travelling structure with a roller or a roller and the like. The filter screen 7 divides a space inside the housing into a water inlet chamber 100 and a water outlet chamber 110, wherein the water inlet chamber 100 is in communication with water inlets 21 at the bottom of the housing, the water outlet chamber 110 is in communication with water outlets 42. Under the action of impeller 5, water in a swimming pool enters the water inlet chamber 100 through the water inlet 21, and then the impurities stay in the water inlet chamber 100 under the action of the filter screen 7, and the water passing through the filter screen 7 enters the water outlet chamber 110. Two groups of power components with opposite driving directions are arranged in the water outlet chamber 110, and when the different power components operate, the swimming pool cleaner can be driven to move in opposite directions. Specifically, the power component includes the impeller 5 and water outlet channel 15, an inlet 51 of the impeller 5 is in communication with the water outlet chamber 110, an outlet 52 of the impeller 5 is in communication with the water outlet channel 15, and the water entering the water outlet chamber 110 can flow into the water outlet channel 15 under the action of the impeller 5. The water outlet channel 15 includes a spiral portion 152 and a linear flowing portion 153 which are sequentially communicated, the linear flowing portion 153 is communicated with the water outlet 42, the water flowing into the water outlet channel 15 is discharged out of the swimming pool cleaner through the water outlet 42. Referring to FIG. 4, the linear flowing portion 153 deflects outward in a spiral direction of the spiral portion 152, and a steering stressed portion 154 is formed at the junction of the linear flowing portion 153 and the spiral portion 152, the water flowing out of the spiral portion 152 may impact the steering stressed portion 154 and then be deflected forcibly to flow to the linear flowing portion 153, therefore, a force in the spiral direction of the spiral portion 152 is applied to the steering stressed portion 154, and the force can drive the swimming pool cleaner to deflect to some extent. The water outlet 42 is connected to outside of the housing and faces towards a direction that is opposite to the travelling direction of the travelling device 3. Thus, the swimming pool cleaner can be driven to travel by the reaction force of the water flow discharged from the water outlet 42. Since the swimming pool cleaner is subjected to both the steering thrust force of the steering stressed portion 154 and the travelling thrust force of the water flow discharged from the water outlet 42, the swimming pool cleaner will travels to the left front or right front, and different travelling directions can be controlled by controlling the operations of different power components, and thus a zigzag travelling route covering a bottom surface area of the swimming pool can be formed in the swimming pool, the swimming pool can be cleaned relatively thoroughly. In conclusion, in the present disclosure, by designing the water outlet channel 15 to have the spiral portion 152 and the linear flowing portion 153, the steering stressed portion 154 can be formed between the spiral portion 152 and the linear flowing portion 153, and the impact of the steering stressed portion 154 is generated by the flowing of the water flow while the water in the swimming pool is extracted and filtered, so that the swimming pool cleaner may be deflected in the impact direction, and the zigzag travelling route is finally formed without additional electronic elements for such as steering and state monitoring, thus, the complexity of the structure is reduced, and the manufacturing cost is reduced too.

Figure 2:
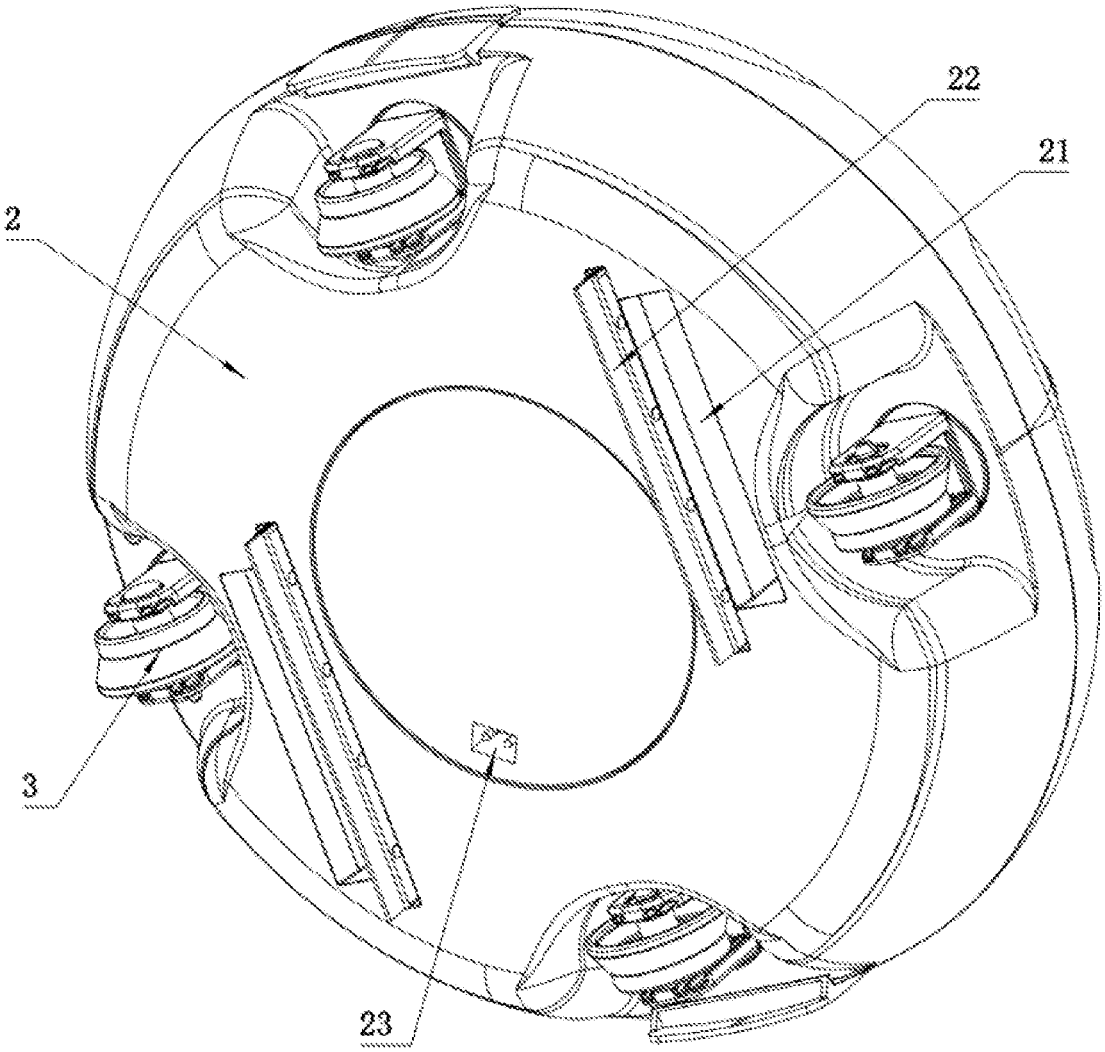
FIG. 2 is a bottom structural schematic diagram of the present disclosure.

In conjunction with what is shown in FIG. 2, one of the water inlets 21 is located on a right side of the travelling device 3 with respect to the travelling direction of the travelling device, and in conjunction with what is shown in FIG. 4, the steering stressed portion 154 is subjected to a counterclockwise deflecting force, and at this moment, the swimming pool cleaner travels to the left and the front. Alternatively, another form is also provided, which is not shown in the figures, that is, the water inlet 21 is located on a left side the travelling device 3 with respect to the travelling direction of the travelling device, the steering stressed portion 154 is subjected to a clockwise deflecting force, and at this moment, the swimming pool cleaner travels to the right and the front. By matching the water inlet 21 provided on the right side of the travelling device with a counterclockwise deflection, and matching the water inlet 21 provided on the left side of the travelling device with a clockwise deflection (not shown in the figures), the water inlet 21 can be located at the outer diameter side of the deflection arc; in addition, a scraper 22 is further provided on the rear side of the water inlet 21, and the dirt on the ground of the swimming pool can be better cleaned by using the scraper 22 and the relationship between the water inlet 21 and the travelling direction. In addition, the water inlet 21 can be in the form of an elongated opening. The scraper 22 is parallel to the length direction of the water inlet 21, and the length of the scraper 22 is slightly greater than the length of the water inlet 21, so that a larger cleaning area can be covered, and dirt can be better collected and pumped by the water inlet 21.

As shown in FIGS. 1, 2 and 13, 14, the travelling device 3 includes travelling wheels 32, and each of the travelling wheels 32 is rotatably mounted on a wheel frame 33 via a wheel shaft 31. The top of the wheel frame 33 is provided with a positioning block 332 and an annular groove 331, and the housing (the lower housing 2) is provided with a positioning groove 26 corresponding to the positioning block 332. A first buckle 25 corresponding to the annular groove 331 is provided, and after the positioning block 332 is clamped into the positioning groove 26, the first buckle 25 can be clamped into the annular groove 331 to fix the wheel frame 33. Two positioning grooves 26 are provided at symmetrical positions on the lower housing 2, which make the mounting orientations of the travelling device 3 replaceable to facilitating the mounting based on the requirement of different direction of the travelling device 3. A U-shaped groove is provided at a position where the travelling wheel 32 is mounted on the wheel frame 33, and two supporting arms of the U-shaped groove are provided with a large through-hole and a small through-hole respectively for being penetrated by the wheel shaft 31, the wheel shaft 31 is arranged to include a small diameter portion and a large diameter portion which are connected to each other, wherein the small diameter portion is smaller in diameter than the small through-hole, namely, the small diameter portion can smoothly pass through the small through-hole, and the large diameter portion has a diameter between the diameter of the small through-hole and the diameter of the large through-hole, namely, the large diameter portion can smoothly pass through the large through-hole but cannot pass through the small through-hole. Therefore, when mounting the wheel shaft 31, the mounting can only be performed in one manner, so as to ensure the unification when mounting different travelling devices 3.

The small diameter portion may include two elastic strips arranged opposite to each other and two clamping heads connected to free ends of the two elastic strips respectively, and a deformation seam is provided between the two elastic strips. When the two elastic strips are deformed close to each other, the overall diameter of the two clamping heads can be reduced, so that the overall diameter of the two clamping heads are less than that of the small through-hole, so that it is convenient for the clamping head to pass through the small through-hole, and the clamping heads passing through the small through-hole are restored to a free state, and the overall diameter of the two clamping heads in the free state are greater than that of the small through-hole, thus, the wheel shaft 31 can be limited, and the wheel shaft 31 can be prevented from detachment along the original path. The large diameter portion may be a cross-shaped shaft. One end of the cross-shaped shaft is connected to the small diameter portion, and the other end of the cross-shaped shaft is connected to a limiting plate. The clamping heads and the limiting plate are separately located at two sides of the wheel frame 33 respectively, which limits the wheel shaft 31 on the wheel frame 33.

In conjunction with what is shown in FIG. 2, the travelling wheels 32 are disposed on an outer surface of a bottom of the housing (the lower housing 2) in a cross-shaped arrangement, one of the travelling wheels 32 on the left side and one of the travelling wheels 32 on the right side are symmetrically arranged, a gravity center of one of the travelling wheels 32 on the front side and a gravity center of one of the travelling wheels 32 on the rear side are provided in an offset arrangement and are offset towards respective water inlets. When the swimming pool cleaner travels, the swimming pool cleaner is subjected to the deflecting force of the steering stressed portion 154, and the resistance at the side where the water inlet 21 is located is relatively large according to the travelling manner of the swimming pool cleaner described above and the cleaning action manner of the water inlet 21 and the scraper 22, and by means of the center offset arrangement, the side where the water inlet 21 is located can be better supported, further, under the effect of the deflecting force acting on the steering stressed portion 154, the deflecting resistance caused by the travelling wheels 32 can be reduced for better realizing deflection of the swimming pool cleaner. Furthermore, the position of the gravity centre offset of the travelling wheel 32 provided in a offset arrangement can be combination with the force conditions of the steering stressed portion 154 for coupling analysis to get a rational design. By means of the rational design, the micro arc-shaped travelling of the swimming pool cleaner can be guaranteed, and the coverage effect for cleaning the swimming pool is improved, so as to realize blind corner cleaning.

Figure 3:
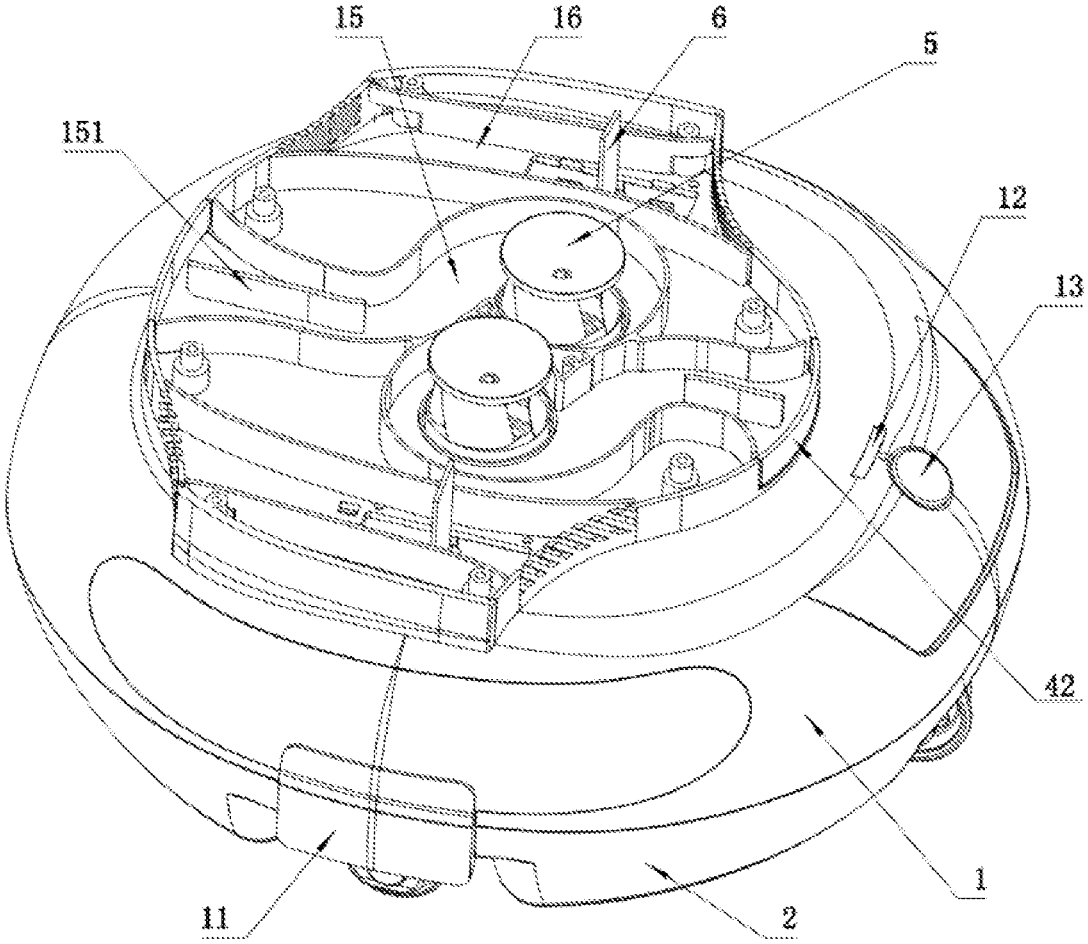
FIG. 3 is a sectional view of FIG. 1 showing a water outlet channel.
Figure 4:
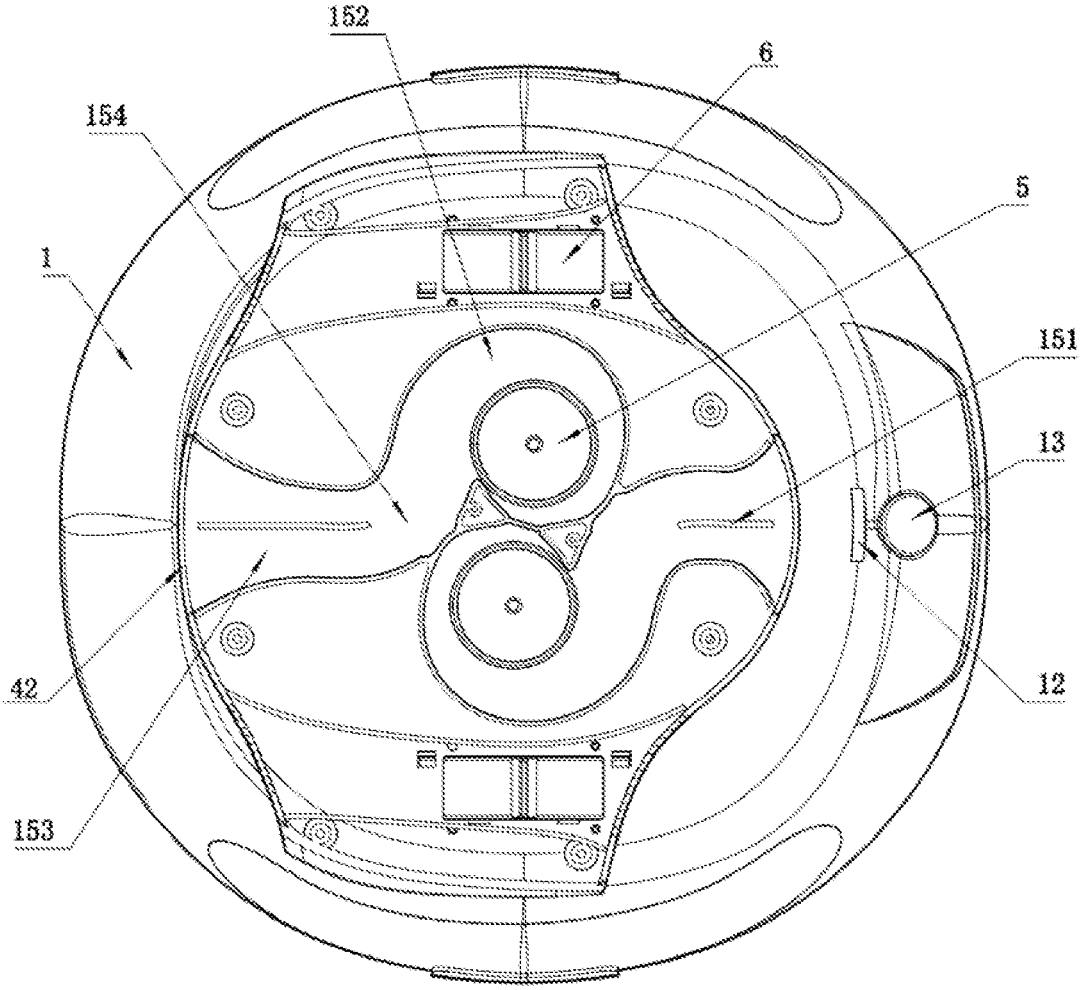
FIG. 4 is a top view of FIG. 3.
Figure 9:
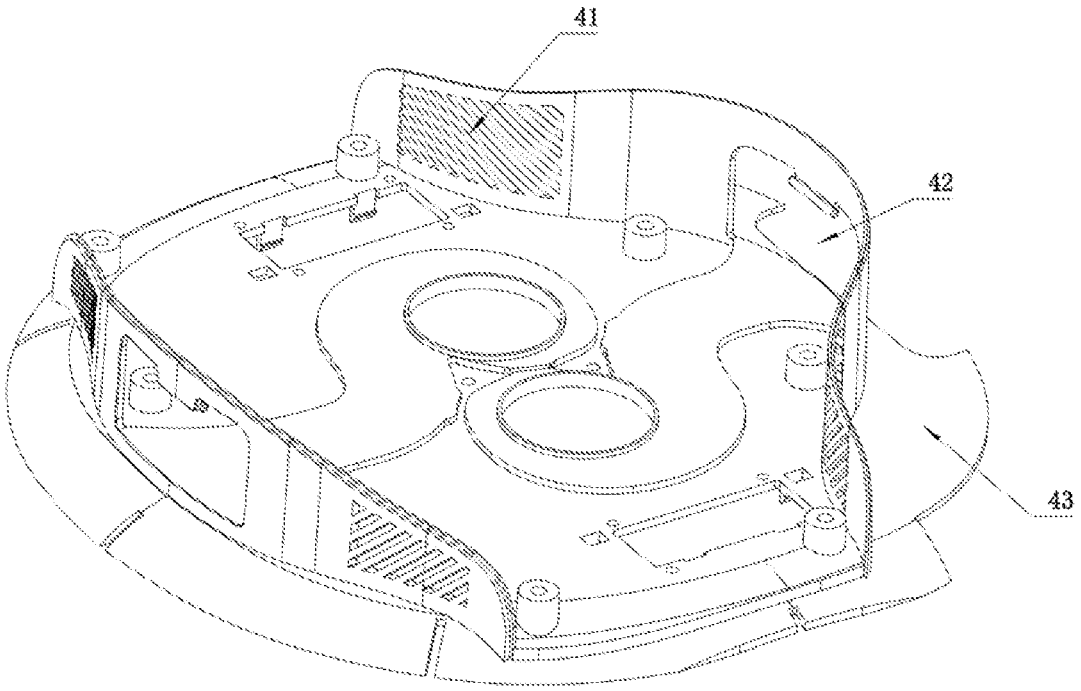
FIG. 9 is a structural schematic diagram of an integrated grille plate of the present disclosure.

As shown in FIGS. 3 and 4, a flow distribution plate 151 is provided in each of the linear flowing portion 153 in a direction parallel to extending direction of the linear flowing portion 153, and the flow distribution plate 151 can divide the water flow flowing toward outside to generate a turbulent flow and also can form an effective support structure, so as to keep the water outlet channel 15 smooth and structurally stable. The water outlet 42 has a flared structure to facilitate the diffusion of the water flow. Referring to FIGS. 1 and 9, a swing-out baffle 44 is hinged to the water outlet 42 at an upper part of the swing-out baffle 44. Since the water outlets 42 arranged in the opposite direction does not work at the same time, when the water outlet 42 is in a working state, the swing-out baffle 44 is impinged by the water flow, so that the water outlet 42 is accessible, and when the water outlet 42 is not in the working state, the water outlet 42 is closed by the self-weight of the swing-out baffle 44 as there in not the impact of the water flow.

As shown in FIGS. 3-6 and 10-12, wall contact sensing assemblies 6 are arranged on the housing (the upper housing 1), and each the wall contact sensing assemblies 6 includes a swinging member 62 rotatably provided on the upper housing 1 and a Hall sensing probe 83 fixedly provided on the lower housing 2, the Hall sensing probe 83 can detect the position state of the swinging member 62 to determine whether the swimming pool cleaner touches the wall, and then send the control signal to control the operation of the power component, thereby changing the travelling direction. The swinging member 62 includes a rotation portion 622, and a resistance plate 621 and a magnet seat connected to the rotation portion 622. When the resistance plate 621 is impacted by the water flow, the swing position around the rotation portion 622 can be changed. A magnet is mounted on the magnet seat. By means of the swing of the resistance plate 621, the position of the magnet relative to the Hall sensing probe 83 can be changed. The resistance plate 621 is located in a wall contact detection water channel 16 which penetrates from front to back. When the swimming pool cleaner travels, the water flow passes through the wall contact detection water channel 16, at this moment, the resistance plate 621 is driven by the water flow to deflect the magnet, and then the magnet is left away from the position corresponding to the Hall sensing probe 83. When the swimming pool cleaner contacts the wall of the swimming pool, there is no water flow passes through the contact wall detection water channel 16, and at this moment, the resistance plate 621 is not subjected to the water flow. The magnet sags under the action of gravity thereof and is located at the position corresponding to the Hall sensing probe 83, namely, the Hall sensing probe 83 can detect the touch signal and send the touch signal to the controlling device. By operating different power components, the travelling direction is changed to get out contact with the surface of the wall.

Figure 8:
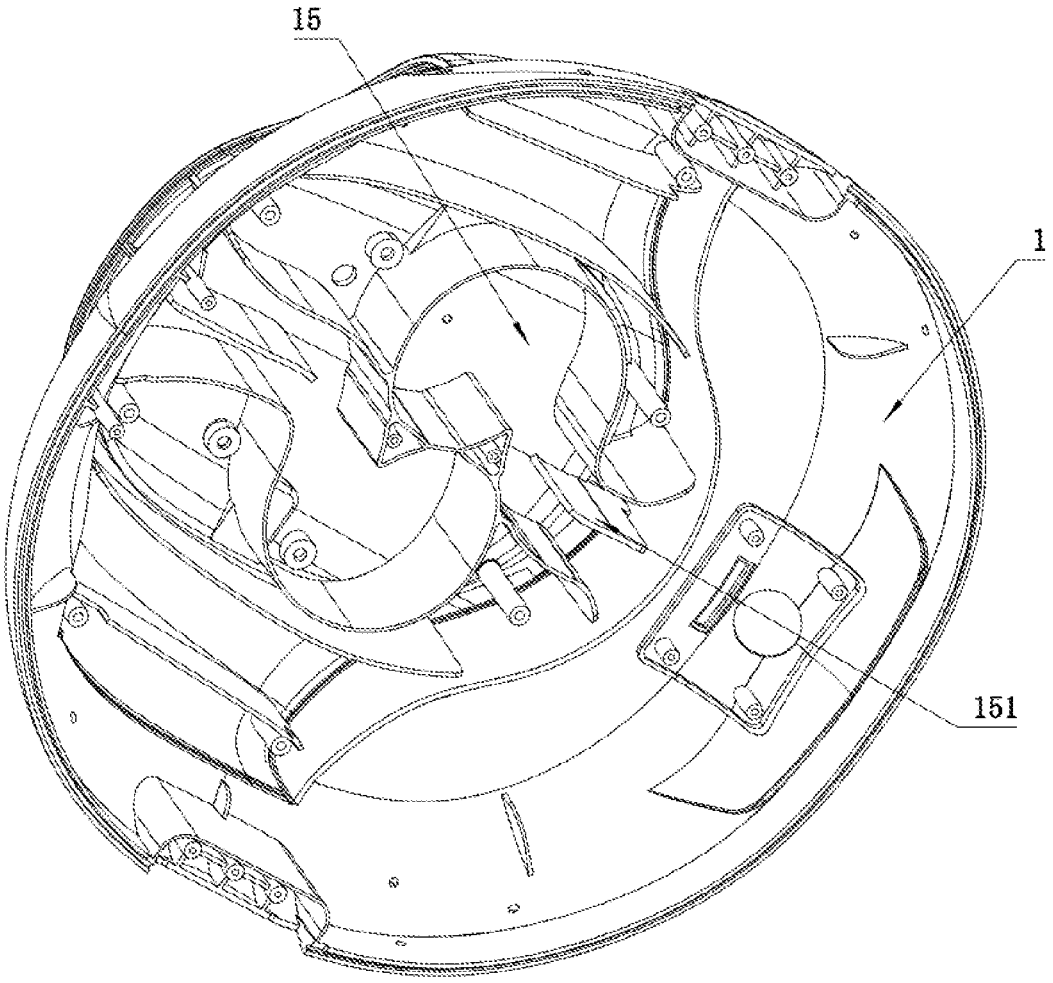
FIG. 8 is a schematic diagram of an internal structure of the upper housing of the present disclosure.

As shown in FIGS. 8-9, a curved baffle structure for forming the water outlet channel 15 is provided inside the upper housing 1, the water outlet chamber 110 is separated by a division plate 43, and the division plate 43 and the upper housing 1 are combined to form the water outlet channels 15. Protective grilles 41 are arranged at an inlet and outlet positions of the wall contact detection water channel 16 respectively, and the protective grilles 41 are used for protecting the water flow entering and exiting the wall contact detection water channel 16, so as to avoid interference on normal operation of the wall contact sensing assembly 6 caused by impurities entering the wall contact detection water channel 16, and the protective grilles 41 and the division plate 43 may be integrally molded as an integral grille plate 4 that is integrally installed, thus, the integrity of installation can be ensured, and the installation difficulty can be reduced.

Figure 10:
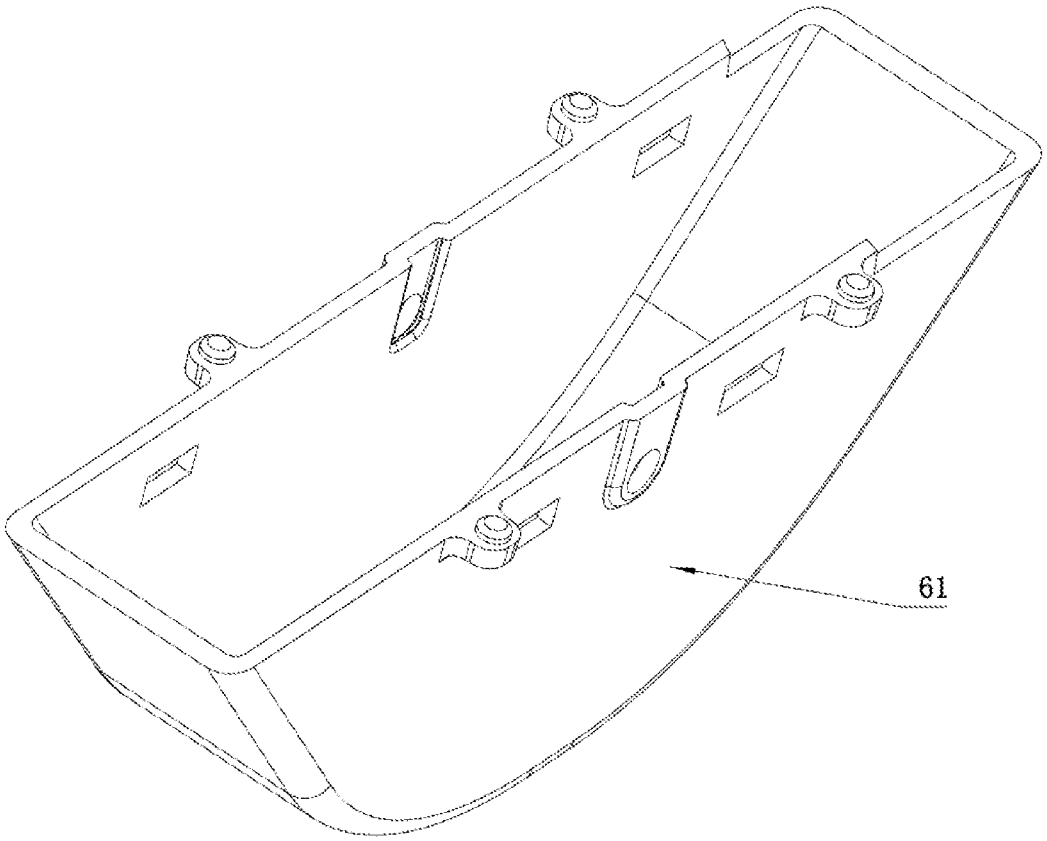
FIG. 10 is a structural schematic diagram of an arc-shaped groove of the present disclosure.
Figure 11:
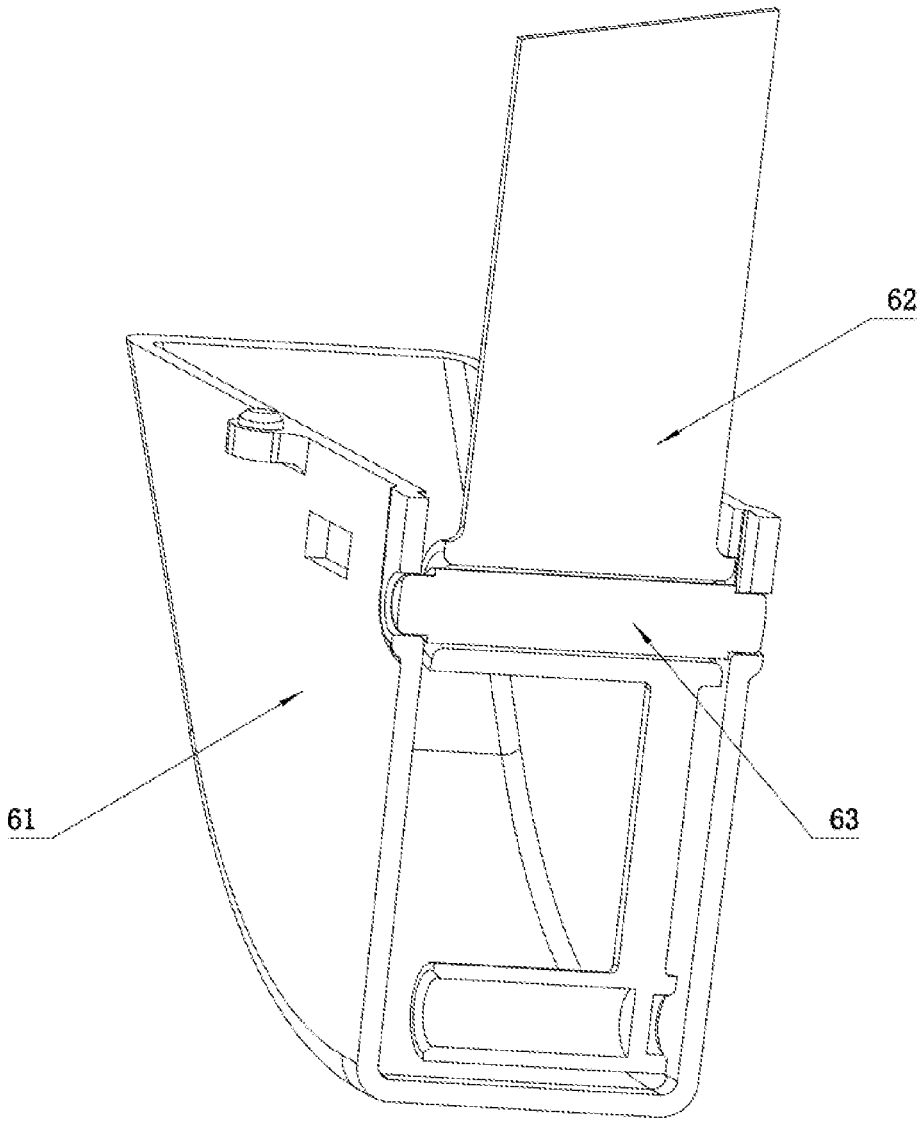
FIG. 11 is a partial structural schematic diagram of a wall contact sensing assembly of the present disclosure.
Figure 12:
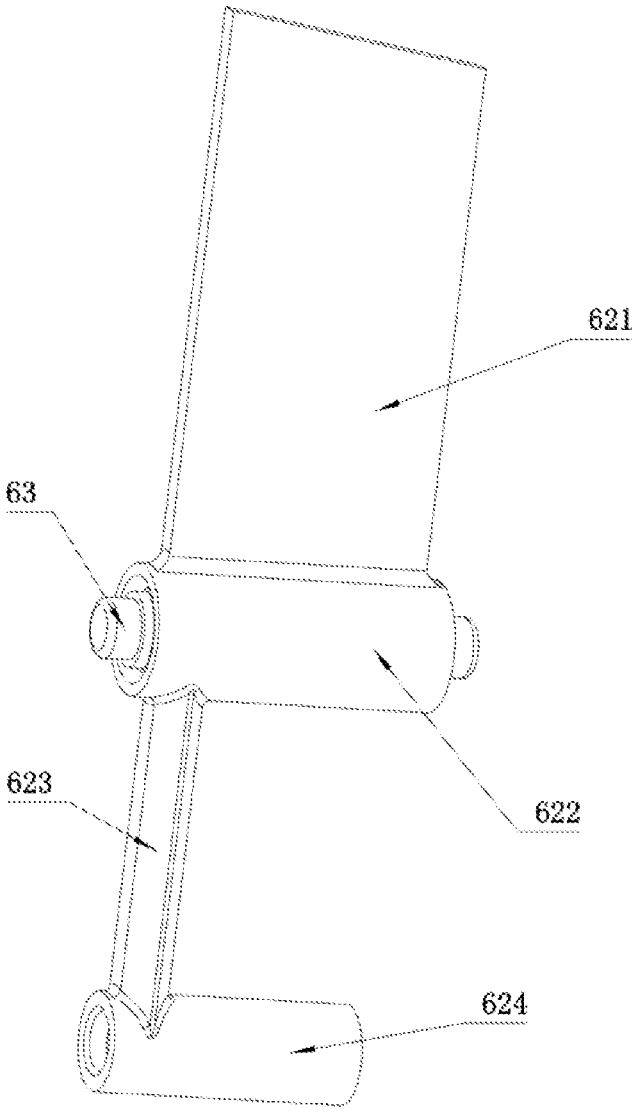
FIG. 12 is a structural schematic diagram of a swinging member of the present disclosure.
Figure 13:
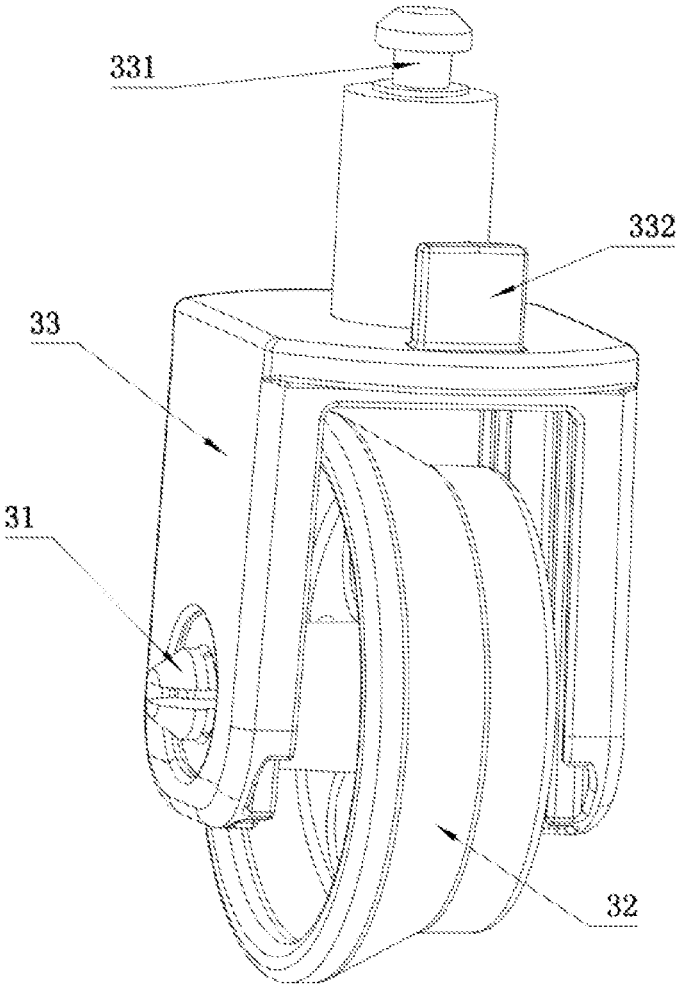
FIG. 13 is a structural schematic diagram of a travelling device of the present disclosure.
Figure 14:
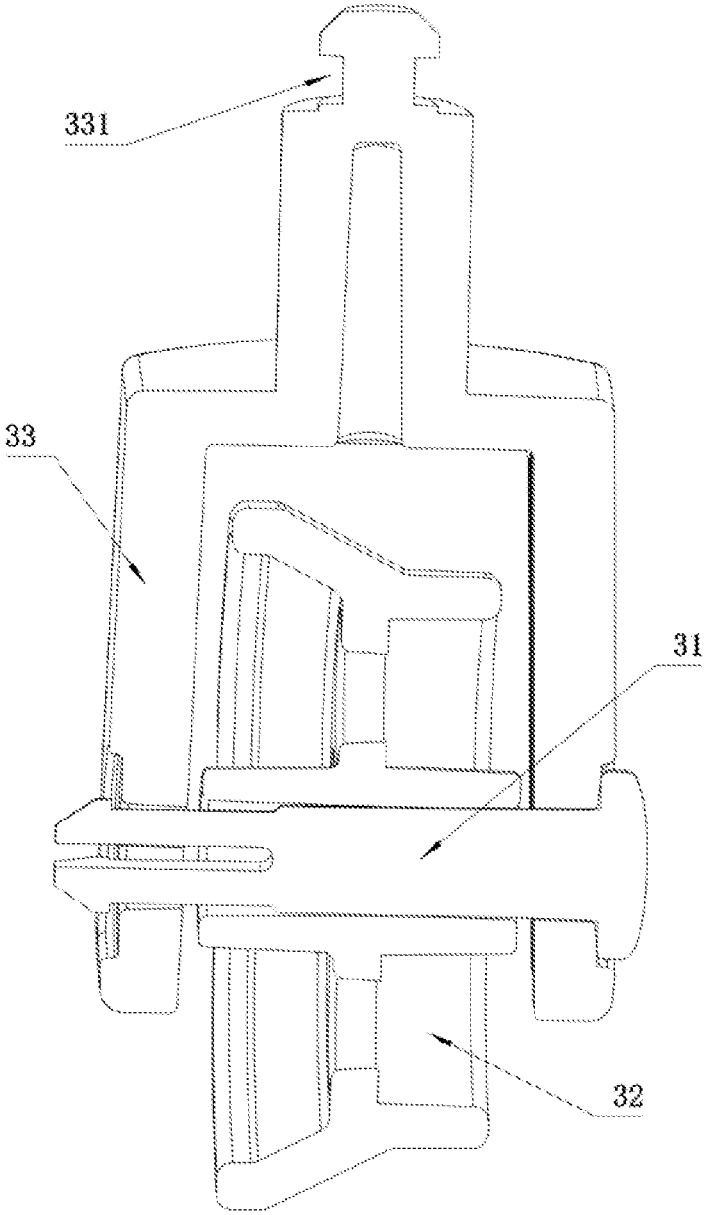
FIG. 14 is a structural schematic sectional diagram of FIG. 13.

As shown in FIGS. 10-12, arc-shaped grooves 61 are provided, and the magnet seat can be provided in the arc-shaped groove 61 to eliminate the impact on the magnet seat caused by the flowing of the water flow in the water outlet chamber 110 when the impeller 5 is in a normal working state; and when the swimming pool cleaner contacts the wall and then keep still, the magnet seat can naturally sag so that the magnet corresponds to the Hall sensing probe 83. A central shaft 63 is rotatably erected on the two side walls of the arc-shaped groove 61, and the rotation portion 622 of the swinging member 62 is rotatably sleeved on the central shaft 63, namely, the rotation portion 622 is rotatably connected to the central shaft 63 to form a one-stage rotational connection, two ends of the central shaft 63 are respectively provided with shaft shoulders, two shaft shoulders are rotatably clamped on two side walls of the arc-shaped groove 61, namely, the central shaft 63 is rotatably connected to the arc-shaped groove 61 to form a one-stage rotational connection, when one of the one-stage rotations is affected by debris and then cannot rotate, the other of the one-stage rotations can be used to prevent the swinging member 62 from getting stuck, so as to ensure the stable operation of the wall contact sensing assembly 6. In addition, the distance between the two shaft shoulders of the central shaft 63 is greater than the axial width of the swinging member 62, so that when the arc-shaped groove 61 is deformed and contracted, two side walls of the arc-shaped groove 61 can be supported, thereby preventing the two side walls of the arc-shaped groove 61 from affecting the swinging of the swinging member 62, and further improving the operation reliability of the wall contact sensing assembly 6.

As shown in FIGS. 11-12, the magnet seat includes a swinging arm 623 connected to one side of the rotation portion 622 close to the Hall sensing probe 83 and a magnet mounting portion 624 connected to the swinging arm 623. The swinging arm 623 is arranged close to the side of the rotation portion 622 close to the Hall sensing probe 83, which can ensure the stability of the distance between the magnet and the Hall sensing probe 83, and prevent factor such as the deformation of the swinging arm 623 from causing a deviation in distance between the magnet and the Hall sensing probe 83 and affecting the sensing accuracy of the wall contact sensing assembly 6. The water-facing surface of the swinging arm 623 is provided as a wedge shape, which can further reduce the resistance affecting swing of the swinging member 62, and improve the reliability of the wall contact sensing assembly 6. The magnet is provided on one side of the magnet mounting portion 624 close to the Hall sensing probe 83, and a first counterweight block is provided on another side of the magnet mounting portion 624 away from the Hall sensing probe 83, on the one hand, the first counterweight block can balance the weight of the magnet to reduce the bending influence on the swinging arm 623, on the other hand, the first counterweight block may increase the entire weight of the magnet mounting portion 624, so that the magnet mounting portion 624 can sag smoothly when the resistance plate is not subjected the impact of the water flow.

Figure 15:
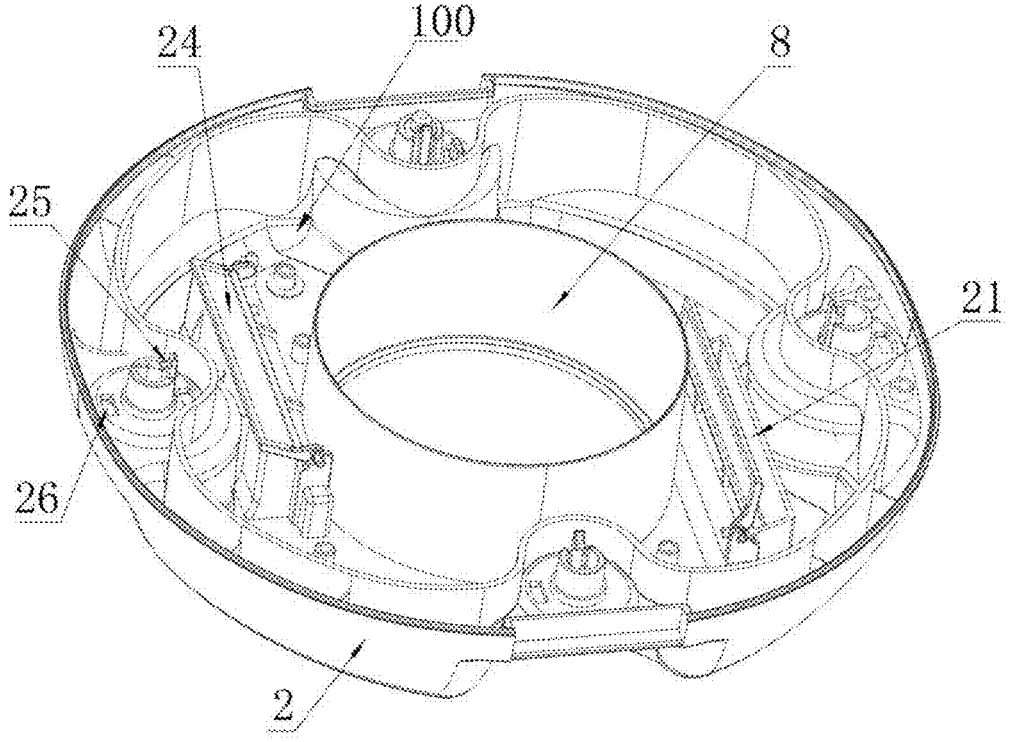
FIG. 15 is a schematic diagram of an internal structure of a lower housing of the present disclosure.
Figure 16:
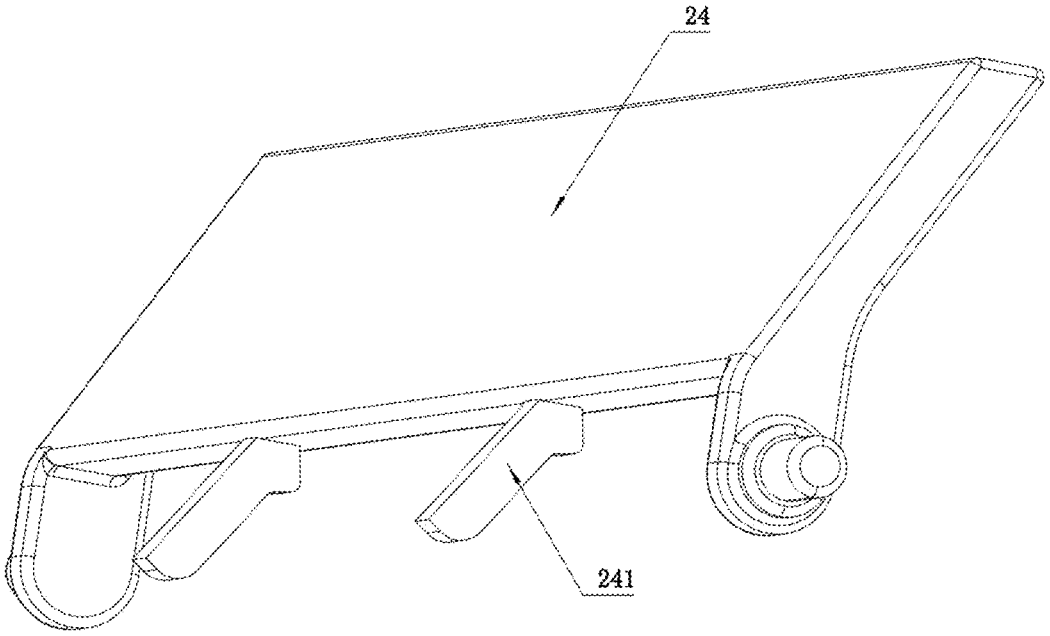
FIG. 16 is a structural schematic diagram of a swing-in baffle of the present disclosure.

As shown in FIGS. 15-16, a swing-in baffle 24 is hinged to the water inlet 21; when the impeller 5 operates, the water flow is drawn into the water inlet chamber 100; under the action of the water flow, the swing-in baffle 24 is flushed by the water flow so as to ensure that the water flow enters smoothly; and after the impeller 5 stops working, the swing-in baffle 24 seals the water inlet 21 by its own weight to avoid the leakage of dirt drawn into the water inlet chamber 100. The swing-in baffle 24 is connected to a limiting portion 241, and the limiting portion 241 is at a certain angle with the swing-in baffle 24. When the swing-in baffle 24 is opened, the limiting portion 241 can limit the swing angle of the swing-in baffle 24 less than 90 degrees. When there is not the impact of the water flow, the swing-in baffle 24 can seal the water inlet 21 by its own weight. By means of the arrangement of the swing-in baffle 24, when water is drawn, the water can smoothly enter the water inlet chamber 100 via the water inlet 21, and the swing angle of the swing-in baffle 24 can be limited via the limiting portion 241, thereby avoiding the problem that the water inlet 21 cannot be sealed by its own weight due to the excessive swing angle thereof, and dirt which have been filtered in the water inlet chamber 100 are discharged again, so that the smooth progress of the cleaning process can be ensured.

Figure 5:
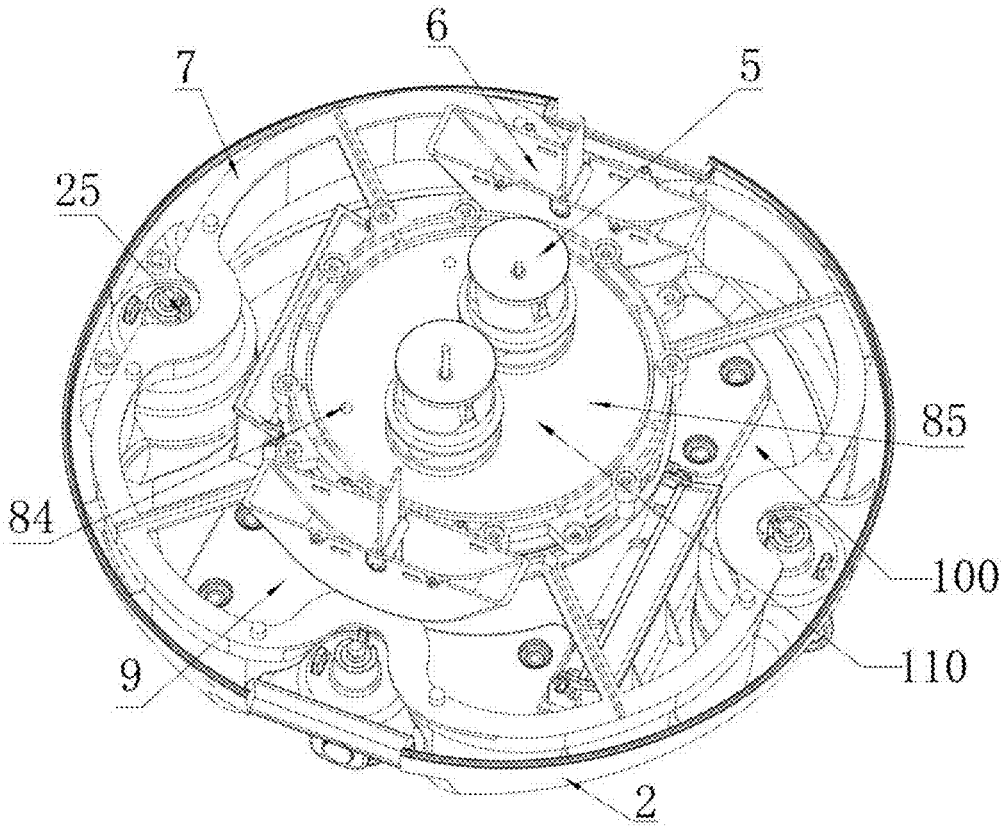
FIG. 5 is a structural schematic diagram of the present disclosure after an upper housing is removed.
Figure 6:
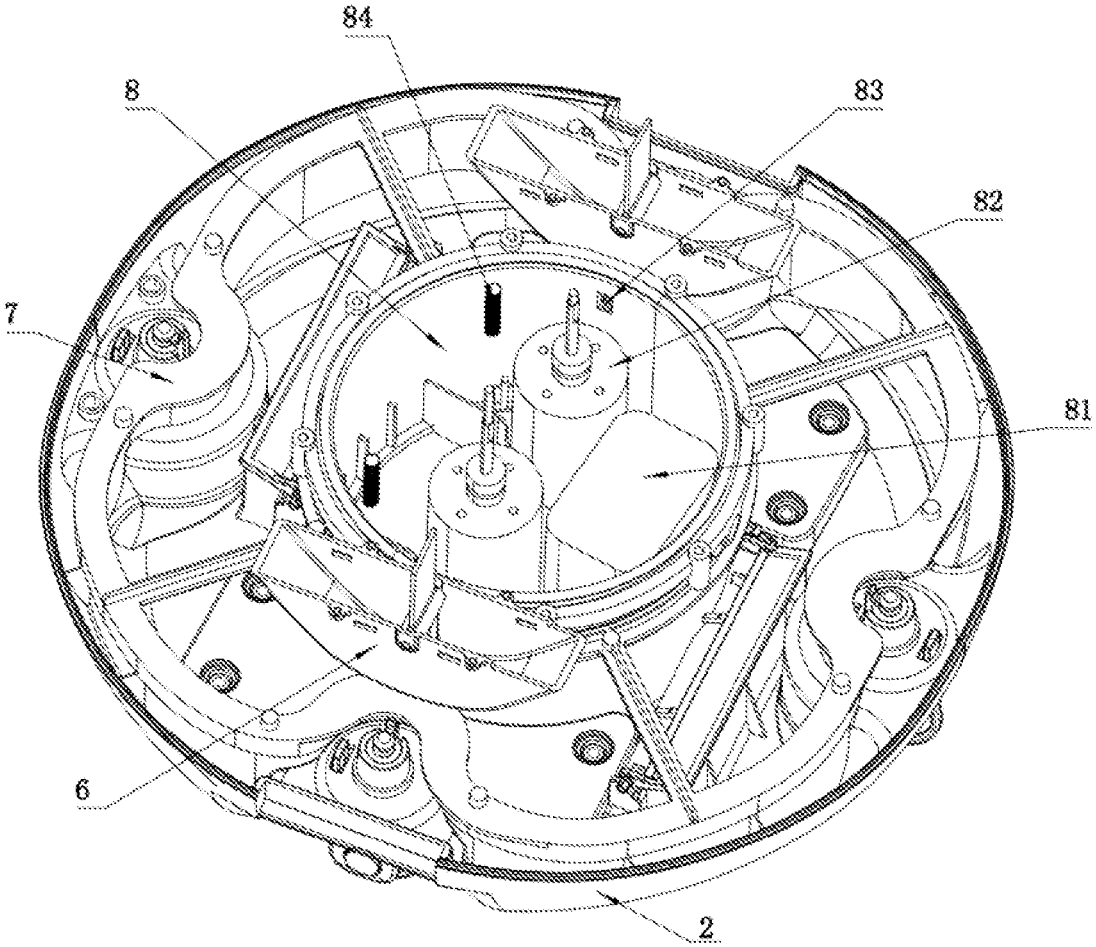
FIG. 6 is a structural schematic diagram of FIG. 5 after a control cabin cover is removed.
Figure 17:
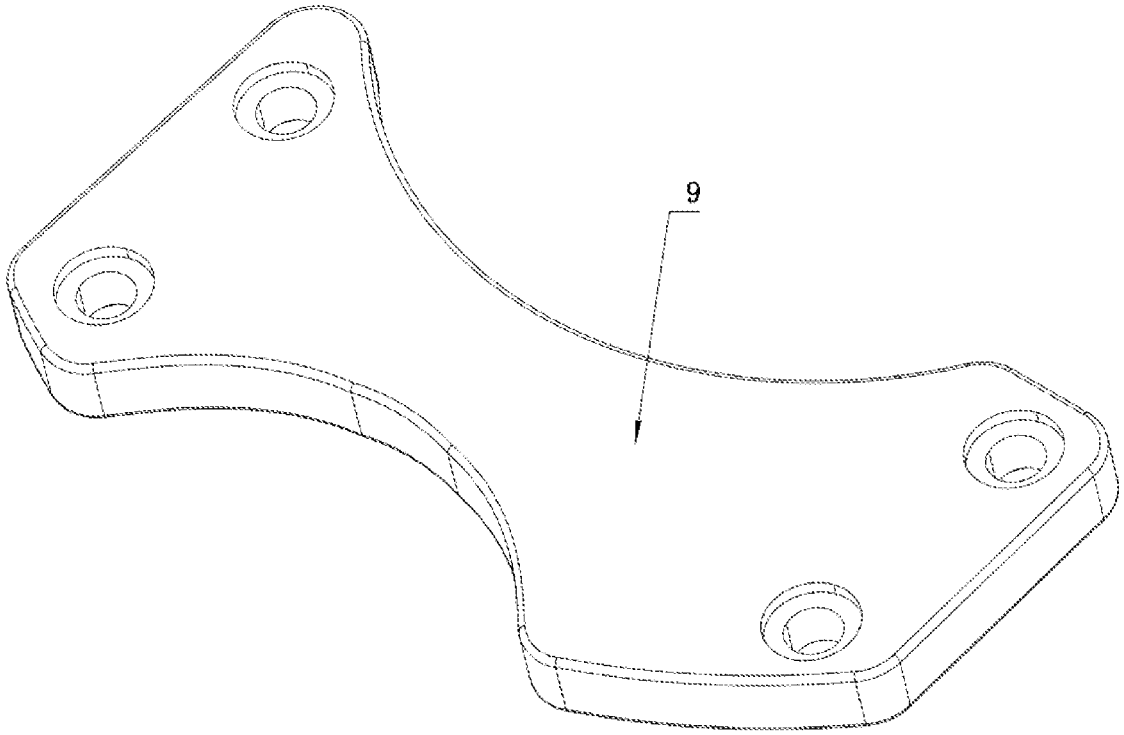
FIG. 17 is a structural schematic diagram of a second counterweight block of the present disclosure.
Figure 18:
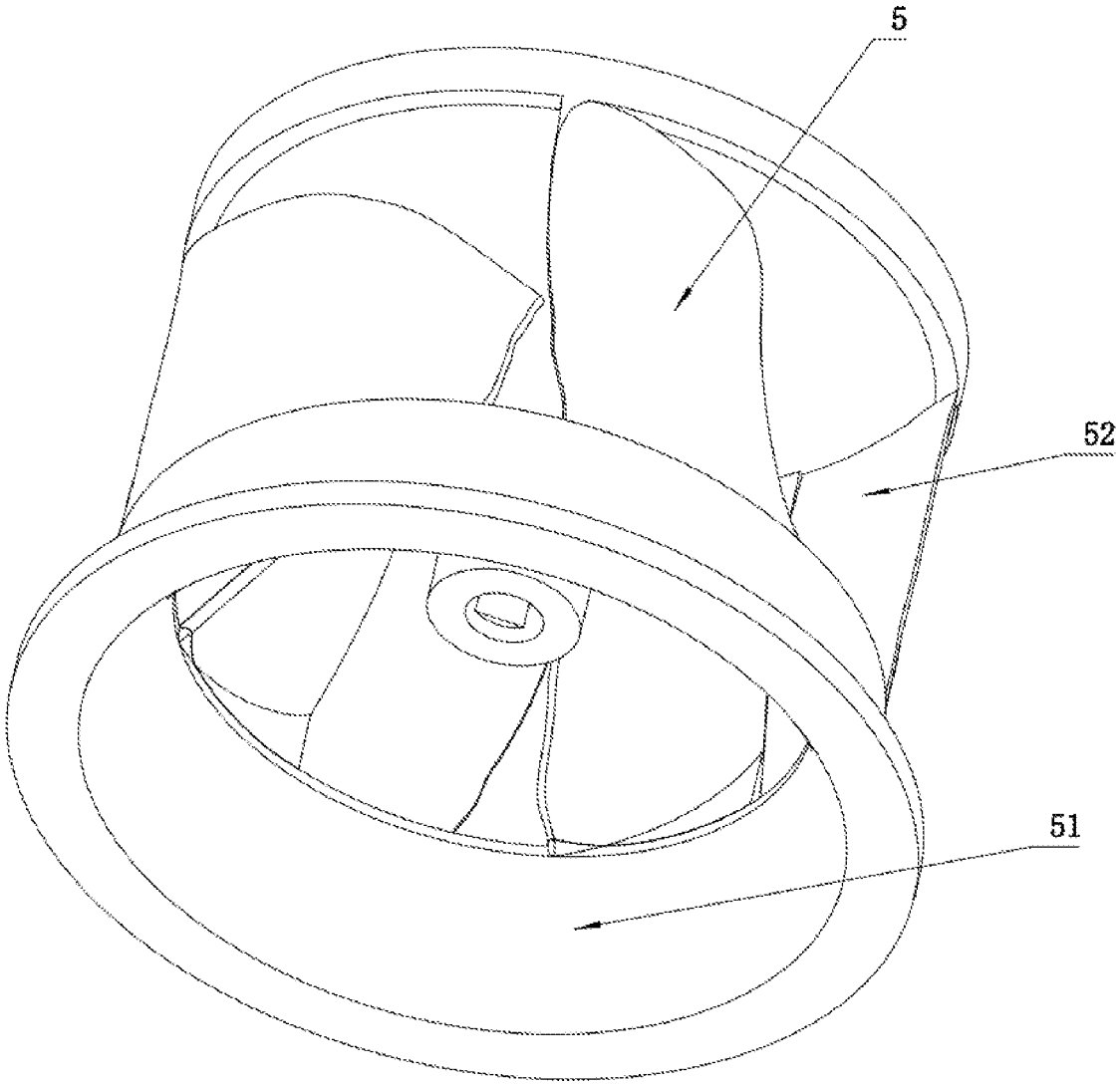
FIG. 18 is a structural schematic diagram of an impeller of the present disclosure.

As shown in FIGS. 5-6, a control cabin 8 is provided in the middle of the lower housing 2, and a battery 81 for supplying power is provided in the control cabin 8, the battery 81 is charged via a charging port 23 (as shown in FIG. 2) provided at the bottom of the lower housing 2, electric motors 82 for driving the impellers 5 to rotate and liquid level probes 84 for sensing the water level are also provided in the control cabin 8, a control cabin cover 85 is provided on the top of the control cabin 8, and the control cabin 8 is sealed and waterproof via the control cabin cover 85, the liquid level probes 84 extend out of the control cabin cover 85, and when the swimming pool cleaner is immersed in the water, the liquid level probe 84 detects a signal and then linkage controls the operation of the impellers 5. As shown in FIG. 1, an indicating light 12 and a switch 13 are provided outside the upper housing 1, and the indicating light 12 and the switch 13 communicate with the components inside the control cabin 8 by means of a circuit, so as to achieve the communication of power supply and control signals. As shown in FIGS. 5 and 17, a second counterweight block 9 may also be provided in the lower housing 2 around the control cabin 8, the second counterweight block 9 is used for improving the overall weight of the swimming pool cleaner, so as to overcome the influence of the water buoyancy and the impact of the water flow, and ensure that the swimming pool cleaner moves smoothly at the bottom of the swimming pool to perform cleaning work.

Figure 7:
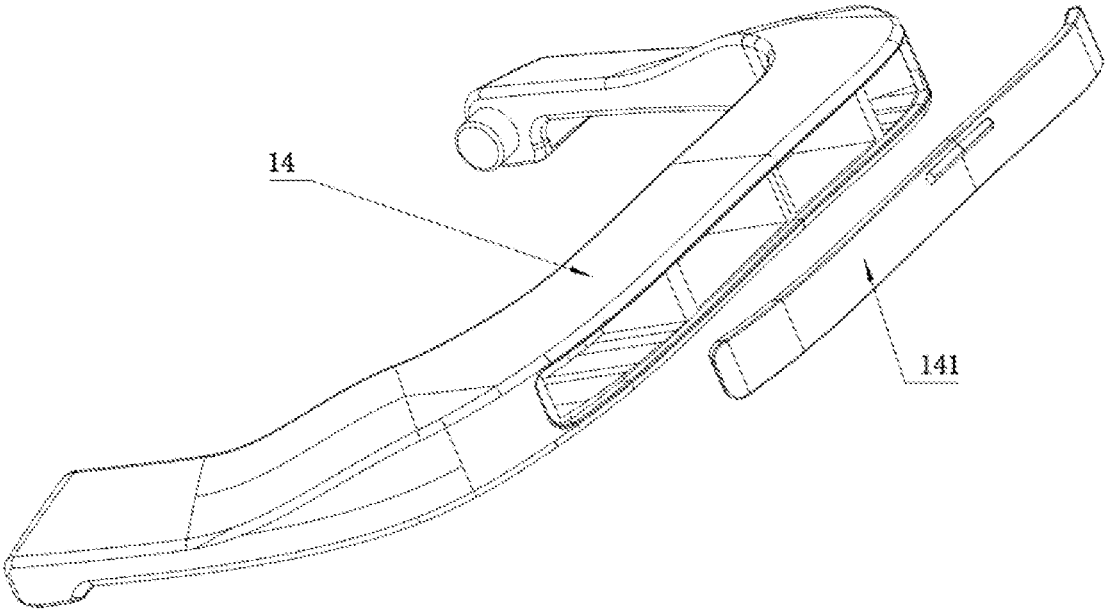
FIG. 7 is an exploded structural schematic diagram of a U-shaped handle of the present disclosure.

As shown in FIG. 7, a U-shaped handle 14 is provided on the top of the housing (the upper housing 1), two supporting legs of the U-shaped handle 14 are hinged on the upper housing 1, and the top of the U-shaped handle 14 is hollow and is sealed via a handle cover 141. The hollow part of the U-shaped handle 14 can be subjected to water buoyancy in water, so that the top of the U-shaped handle 14 can naturally float to be in a vertical state. When it is necessary to extract for charging or repairing, it is convenient to use a tool to clamp the U-shaped handle 14, so as to facilitate the grabbing of the swimming pool cleaner at the bottom of the swimming pool, thereby improving the convenience of operation.

The working process of the present disclosure is as follows:

The switch 13 is turned on, the indicating light 12 shows normal operation, and a tool is used to place the swimming pool cleaner into the swimming pool via the U-shaped handle 14. The water in the swimming pool enters the interior of the swimming pool cleaner via the water inlet 21, the water outlet 42 and the like, and after a water signal is detected by the liquid level probe 84, the impeller 5 is controlled to operate. After the impeller 5 operates, the water enters the water inlet chamber 100 via the water inlet 21, flows into the water outlet chamber 110 after being filtered by the filter screen 7, enters the water outlet channel 15 via the outlet 52 of the impeller 5, and finally is discharged through the water outlet 42. The reaction force of the water flow discharged from the water outlet 42 provides the power for the swimming pool cleaner to travel, further, the swimming pool cleaner receives the steering thrust of the steering stressed portion 154, at this moment, the swimming pool cleaner travels to the left front or the right front, and after contacting the wall surface, the Hall sensing probe 83 in the wall contact sensing assembly 6 detects a corresponding signal, thus, the other power component having an opposite driving direction is started to continue to run, and at this moment, the other impeller 5 is started to continue to run to drive the swimming pool cleaner to travel to the right front or the left front. After contacting the wall surface again, the power component continues to be replaced for changing the direction of driving and travelling, repeat the process, the zigzag travelling route may be formed in the swimming pool to cover the bottom area of the swimming pool and clean the swimming pool relatively thoroughly. When the swimming pool cleaner is required to be charged or cleaned and repaired, the vertical U-shaped handle in the water is hooked by means of a tool and then is taken out; the upper housing 1 and the lower housing 2 are separated by opening the second buckles 11 to clean the dirt therein; and charging is performed via the charging port 23 at the bottom of the lower housing.

The principle and embodiments of the present disclosure are illustrated by using specific examples in the present disclosure, and the description of the above embodiments is only used to help understand the method and core idea of the present disclosure. In addition, a person of ordinary skill in the art may make modifications to the specific implementations and application scopes according to the ideas of the present disclosure. In conclusion, the content of the description shall not be construed as a limitation on the present disclosure.

What is claimed is:

1. A swimming pool cleaner, characterized in that, the swimming pool cleaner comprises a housing, a travelling device arranged at a bottom of the housing, and a filter screen arranged inside the housing, wherein the filter screen divides a space inside the housing into a water inlet chamber and a water outlet chamber, the water inlet chamber is in communication with water inlets at the bottom of the housing, two groups of power components with opposite driving directions are arranged in the water outlet chamber, and each of the two groups of power components comprise an impeller and a water outlet channel, the water outlet channel comprises a spiral portion and a linear flowing portion which are sequentially communicated, and an inlet of the impeller is communicated with the water outlet chamber, an outlet of the impeller is in communication with the spiral portion, the linear flowing portion is connected to a water outlet, and the linear flowing portion deflects to an outer side of a spiral direction of the spiral portion, a steering stressed portion is formed at a junction of the linear flowing portion and the spiral portion, and the water outlet is in communication with an outside of the housing and faces towards a direction that is opposite to the travelling direction of the travelling device.

2. The swimming pool cleaner according to claim 1, characterized in that, one of the water inlets is located on a right side of the travelling device with respect to the travelling direction of the travelling device, and the steering stressed portion is subjected to a counterclockwise deflecting force; alternatively, one of the water inlets is located on a left side of the travelling device with respect to the travelling direction of the travelling device, and the steering stressed portion is subjected to a clockwise deflecting force; a scraper is provided at a rear side of each of the water inlets.

3. The swimming pool cleaner according to claim 2, characterized in that, the travelling device comprises travelling wheels, each of the travelling wheels is rotatably mounted on a wheel frame via a wheel shaft, a positioning block and an annular groove are provided on a top of the wheel frame, a positioning groove is arranged at a position on the housing corresponding to the positioning block, a first buckle is provided corresponding to the annular groove, and the first buckle clamps into the annular groove to fix the wheel frame; the wheel frame is provided with a large through-hole and a small through-hole for being penetrated by the wheel shaft; the wheel shaft comprises a small diameter portion and a large diameter portion which are connected to each other, wherein the small diameter portion has a diameter smaller than that of the small through-hole, and the large diameter portion has a diameter between the diameter of the small through-hole and a diameter of the large through-hole.

4. The swimming pool cleaner according to claim 3, characterized in that, the travelling wheels are disposed on an outer surface of a bottom of the housing in a cross-shaped arrangement, a gravity center of one of the travelling wheels at a front side and a gravity center of one of the travelling wheels at a rear side are provided in an offset arrangement, and are offset towards respective water inlets.

5. The swimming pool cleaner according to claim 4, characterized in that, the housing is provided with wall contact sensing assemblies, wherein each of the wall contact sensing assemblies comprises a swinging member rotatably arranged on the housing and a Hall sensing probe fixedly arranged on the housing, the swinging member comprises a rotation portion, a resistance plate and a magnet seat which are connected to the rotation portion, a magnet is mounted on the magnet seat, the resistance plate is located in a contact wall detection water channel which penetrates from front to back, and when the resistance plate is subjected to an action of a water flow, the magnet deflects away from the Hall sensing probe, and when the resistance plate is not subjected to the water flow, the magnet corresponds to the Hall sensing probe.

6. The swimming pool cleaner according to claim 3, characterized in that, the housing is provided with wall contact sensing assemblies, wherein each of the wall contact sensing assemblies comprises a swinging member rotatably arranged on the housing and a Hall sensing probe fixedly arranged on the housing, the swinging member comprises a rotation portion, a resistance plate and a magnet seat which are connected to the rotation portion, a magnet is mounted on the magnet seat, the resistance plate is located in a contact wall detection water channel which penetrates from front to back, and when the resistance plate is subjected to an action of a water flow, the magnet deflects away from the Hall sensing probe, and when the resistance plate is not subjected to the water flow, the magnet corresponds to the Hall sensing probe.

7. The swimming pool cleaner according to claim 2, characterized in that, the housing is provided with wall contact sensing assemblies, wherein each of the wall contact sensing assemblies comprises a swinging member rotatably arranged on the housing and a Hall sensing probe fixedly arranged on the housing, the swinging member comprises a rotation portion, a resistance plate and a magnet seat which are connected to the rotation portion, a magnet is mounted on the magnet seat, the resistance plate is located in a contact wall detection water channel which penetrates from front to back, and when the resistance plate is subjected to an action of a water flow, the magnet deflects away from the Hall sensing probe, and when the resistance plate is not subjected to the water flow, the magnet corresponds to the Hall sensing probe.

8. The swimming pool cleaner according to claim 1, characterized in that, a flow distribution plate is arranged in the linear flowing portion in a direction parallel to an extending direction of the linear flowing portion, the water outlet has a flared structure, a swing-out baffle is hinged to the water outlet at an upper part of the swing-out baffle, and the swing-out baffle seals the water outlet by its own weight when it is not subjected to an impact of a water flow.

9. The swimming pool cleaner according to claim 8, characterized in that, the housing is provided with wall contact sensing assemblies, wherein each of the wall contact sensing assemblies comprises a swinging member rotatably arranged on the housing and a Hall sensing probe fixedly arranged on the housing, the swinging member comprises a rotation portion, a resistance plate and a magnet seat which are connected to the rotation portion, a magnet is mounted on the magnet seat, the resistance plate is located in a contact wall detection water channel which penetrates from front to back, and when the resistance plate is subjected to an action of a water flow, the magnet deflects away from the Hall sensing probe, and when the resistance plate is not subjected to the water flow, the magnet corresponds to the Hall sensing probe.

10. The swimming pool cleaner according to claim 1, characterized in that, the housing is provided with wall contact sensing assemblies, wherein each of the wall contact sensing assemblies comprises a swinging member rotatably arranged on the housing and a Hall sensing probe fixedly arranged on the housing, the swinging member comprises a rotation portion, a resistance plate and a magnet seat which are connected to the rotation portion, a magnet is mounted on the magnet seat, the resistance plate is located in a contact wall detection water channel which penetrates from front to back, and when the resistance plate is subjected to an action of a water flow, the magnet deflects away from the Hall sensing probe, and when the resistance plate is not subjected to the water flow, the magnet corresponds to the Hall sensing probe.

11. The swimming pool cleaner according to claim 10, comprising arc-shaped grooves, wherein a central shaft is rotatably erected on two side walls of each of the arc-shaped grooves, the rotation portion is rotatably sleeved on the central shaft, two ends of the central shaft are respectively provided with two shaft shoulders, the two shaft shoulders are rotatably clamped on the two side walls of a corresponding one of the arc-shaped grooves, and a distance between the two shaft shoulders is greater than an axial width of the swinging member.

12. The swimming pool cleaner according to claim 11, characterized in that, the magnet seat comprises a swinging arm connected to one side of the rotation portion close to the Hall sensing probe, and a magnet mounting portion connected to the swinging arm, a water-facing surface of the swinging arm is provided as a wedge shape, and the magnet is provided on one side of the magnet mounting portion close to the Hall sensing probe, a first counterweight block is arranged on one side of the magnet mounting portion away from the Hall sensing probe.

13. The swimming pool cleaner according to claim 1, characterized in that, each of the water inlets is hinged to a swing-in baffle, the swing-in baffle is connected to a limiting portion, a swing angle of the swing-in baffle is limited to less than 90 degrees by the limiting portion, and the swing-in baffle seals a corresponding one of the water inlets by its own weight when it is not subjected to an impact of a water flow.

14. The swimming pool cleaner according to claim 1, characterized in that, a U-shaped handle is arranged on a top of the housing, two supporting legs of the U-shaped handle are hinged on the housing, and a top of the U-shaped handle is hollow and is sealed by a handle cover.

* * * * *